US012220027B2

(12) United States Patent
Zabaldo

(10) Patent No.: US 12,220,027 B2
(45) Date of Patent: Feb. 11, 2025

(54) RIBBON RACK WITH REMOVABLE RIBBONS

(71) Applicant: Jared Zabaldo, Boerne, TX (US)

(72) Inventor: Jared Zabaldo, Boerne, TX (US)

(73) Assignee: USAMM, LLC, Killeen, TX (US)

( * ) Notice: Subject to any disclaimer, the term of this patent is extended or adjusted under 35 U.S.C. 154(b) by 187 days.

(21) Appl. No.: 18/303,706

(22) Filed: Apr. 20, 2023

(65) Prior Publication Data

US 2024/0349850 A1 Oct. 24, 2024

(51) Int. Cl.
*A44C 3/00* (2006.01)

(52) U.S. Cl.
CPC ..... *A44C 3/002* (2013.01)

(58) Field of Classification Search
CPC ..... A44C 3/002
See application file for complete search history.

(56) References Cited

U.S. PATENT DOCUMENTS

| | | | | |
|---|---|---|---|---|
| 2,707,344 | A * | 5/1955 | Bolognese | A41D 29/00 40/1.5 |
| 2,834,129 | A * | 5/1958 | Kirkbride | A44C 3/002 40/1.5 |
| 3,942,273 | A * | 3/1976 | Adams | A44C 3/002 40/1.5 |
| 4,137,657 | A * | 2/1979 | Wardle | A44C 3/002 40/605 |
| 7,096,614 | B1 * | 8/2006 | Williams | A44C 3/002 63/900 |
| 11,107,138 | B2 | 8/2021 | Zabaldo | |
| 2010/0122469 | A1 * | 5/2010 | Allen | B25H 7/02 33/653 |
| 2013/0073417 | A1 | 3/2013 | Zabaldo | |
| 2013/0073418 | A1 | 3/2013 | Zabaldo | |
| 2022/0183425 | A1 * | 6/2022 | Williams | A44C 3/002 |
| 2023/0070141 | A1 * | 3/2023 | Shier | A47F 7/02 |

* cited by examiner

*Primary Examiner* — Gary C Hoge
(74) *Attorney, Agent, or Firm* — John C. Cave; Gunn, Lee & Cave, PC

(57) ABSTRACT

A ribbon rack for the display of military ribbons. The ribbons are detachable via a snap fit between the ribbons and the rack backing. The ribbons can be removed and rearranged as desired by the user.

20 Claims, 7 Drawing Sheets

RIBBON RACK WITH REMOVABLE RIBBONS

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to the manufacture and method of use for a military ribbon rack. Ribbon racks are used by members of the military to display military ribbons, ribbon bars, medals, and other insignia on uniforms. Ribbon racks can be used to display ribbons and other insignia that indicate the military service and personal accomplishments of the wearer. Ribbons can be used to indicate decorations, participation in specific campaigns, and/or awards received by the wearer. Ribbon racks can also be used by law enforcement and other organizations that display ribbons or other ornaments on uniforms. Ribbon racks can be customized to hold the number and style of ribbons appropriate for the user.

A user will often have the need to update or re-arrange his or her ribbon rack over time to indicate new achievements, decorations, or awards.

Standard existing ribbon rack technology requires the ribbons be adhered to the rack backing using a glue-like adhesive. The ribbons cannot be easily removed once adhered to the backing without being damaged, which prevents the user from altering the ribbon display. In such cases, the user has to start over with a new ribbon rack when a new arrangement of ribbons is desired.

SUMMARY OF THE INVENTION

The present invention discloses a ribbon rack with removable and reusable ribbons. The ribbons have a display side and an attachment side. The ribbon rack backing has attachment mechanisms that form a removable snap fit with the attachment sides of the ribbons.

DETAILED DESCRIPTION

Figure 1:
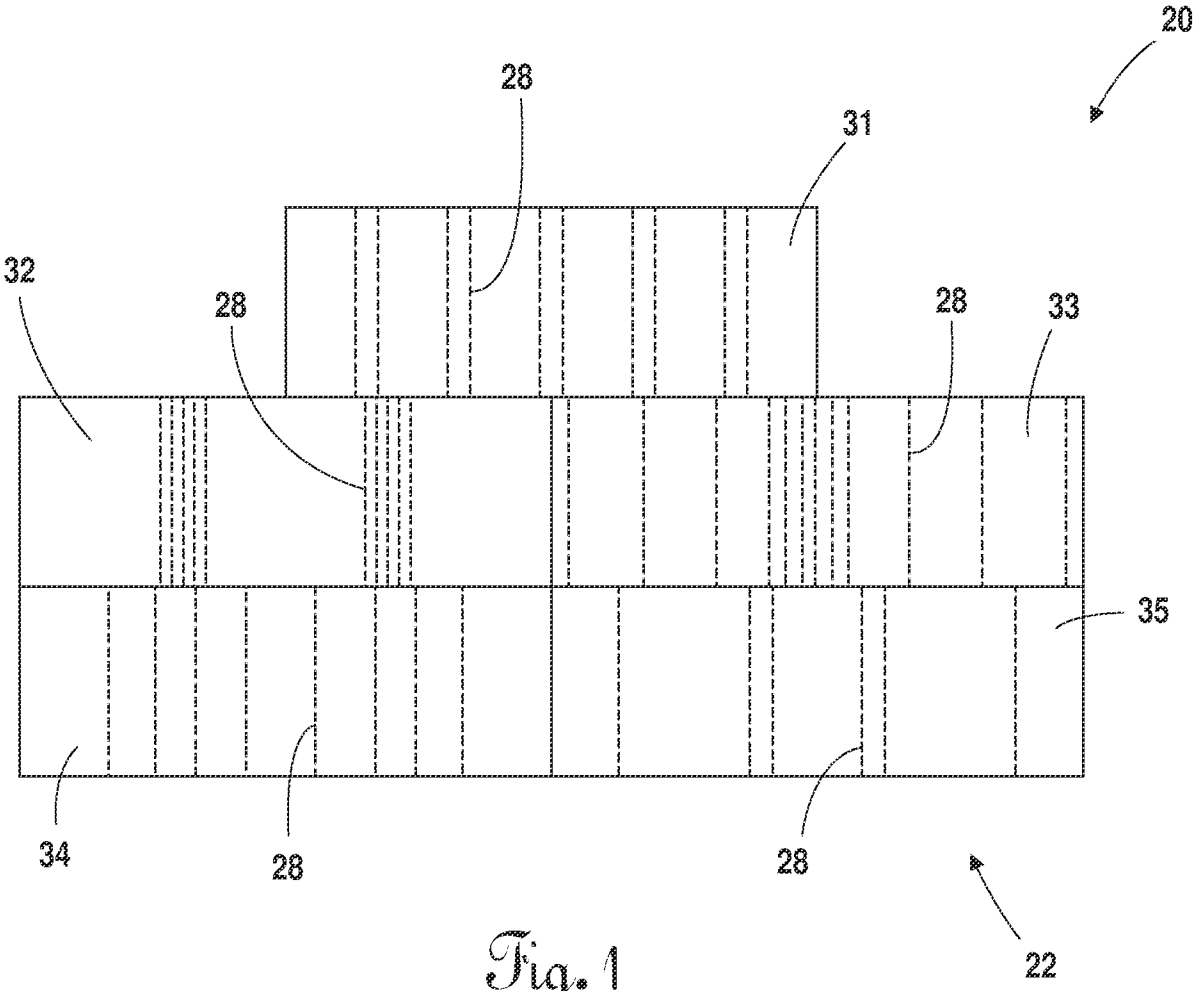
FIG. 1 is a front view of a first embodiment of a fully assembled ribbon rack.

The structure of a first embodiment of the ribbon rack 20 is described with reference to FIGS. 1-7. The ribbon rack 20 comprises a first backing 21 and a first arrangement of a plurality of ribbons 22. In the first embodiment 20, the first arrangement of a plurality of ribbons 22 includes a first ribbon 31, second ribbon 32, third ribbon 33, fourth ribbon 34, and fifth ribbon 35.

Figure 2:
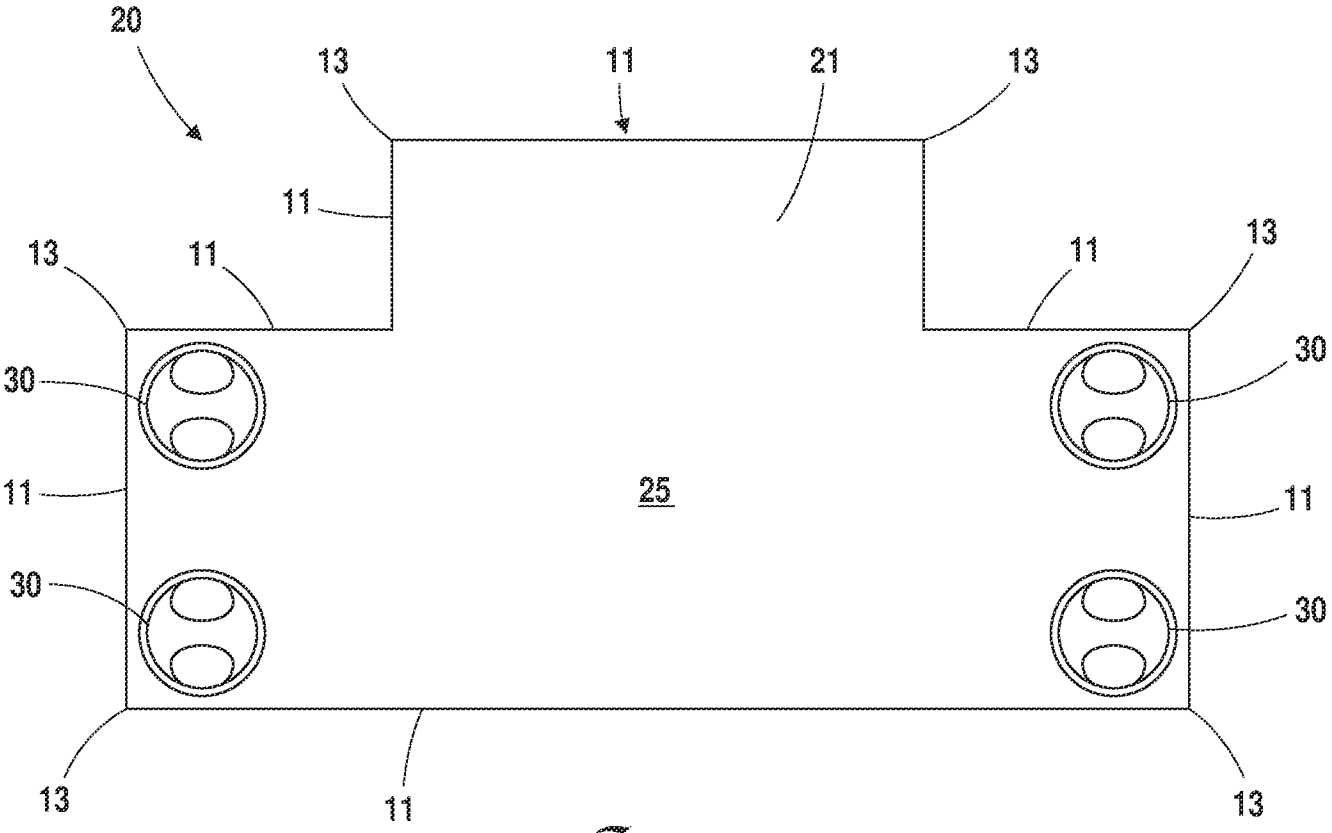
FIG. 2 is a back view of the first embodiment of a fully assembled ribbon rack, showing the back side of the ribbon rack backing.
Figure 3:
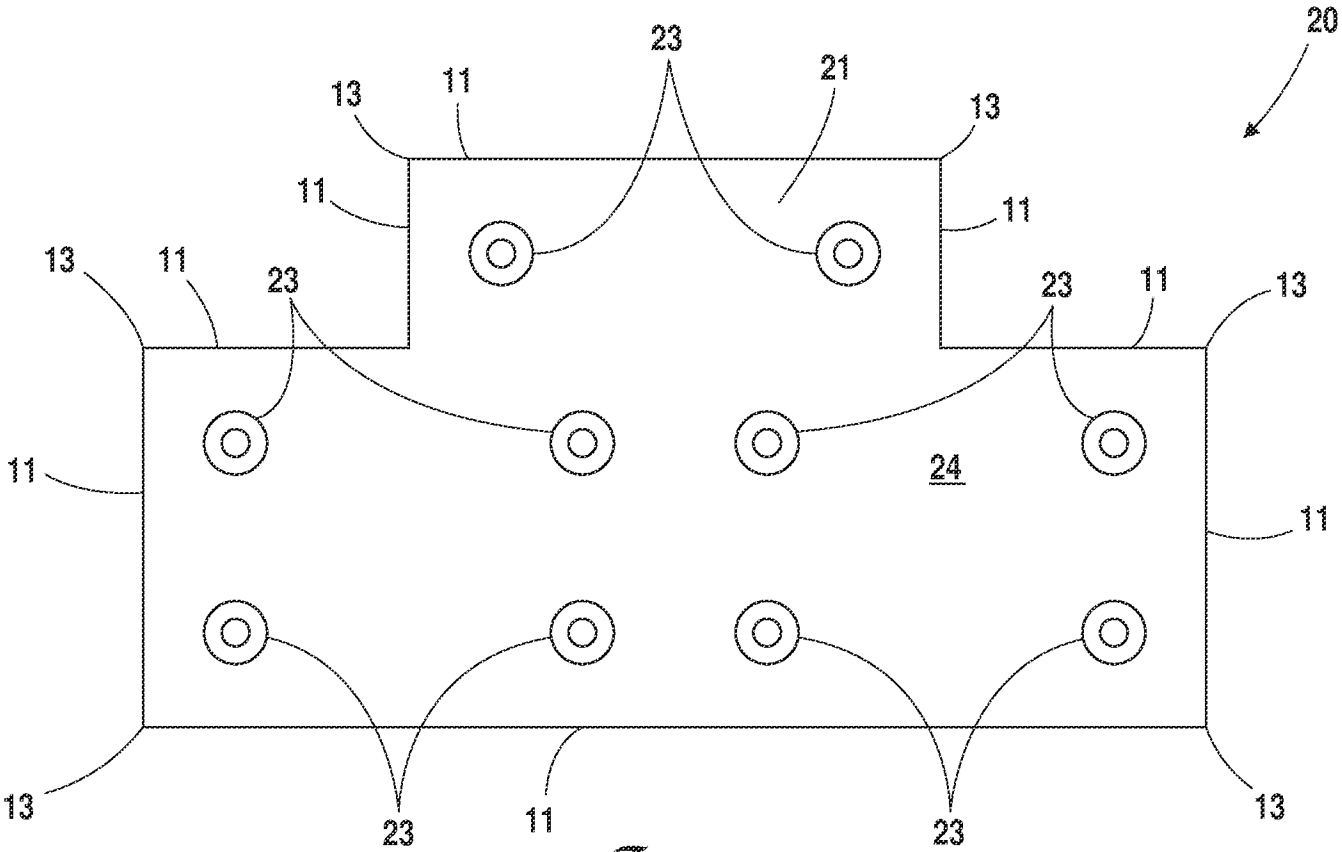
FIG. 3 is a front view of the backing of the first embodiment of the ribbon rack.

Referring to FIGS. 2 and 3, the first backing 21 comprises a front side 24 and a back side 25. A plurality of male snap stud pairs 23 are attached to the front side of the first backing 21. The back side 25 provides a means for attaching the first backing 21 to the exterior of a uniform or other material such as pins 30. The first backing 21 can be in many shapes but preferably will have parallel and perpendicular edges 11 with 90° corners 13. Preferably the first backing 21 is sized and shaped to correspond to shape of the first arrangement of a plurality of ribbons 22. Each of the male snap stud pairs 23 are positioned to correspond to and connect with a female snap socket pair on the ribbons 22.

Each ribbon 31-35 of the first arrangement of a plurality of ribbons 22 is snapped onto the first backing 21 by forming a snap fit between the female snap socket pairs 29 on the ribbons 31-35 with the male snap studs 23 on the backing 21.

Figure 4:
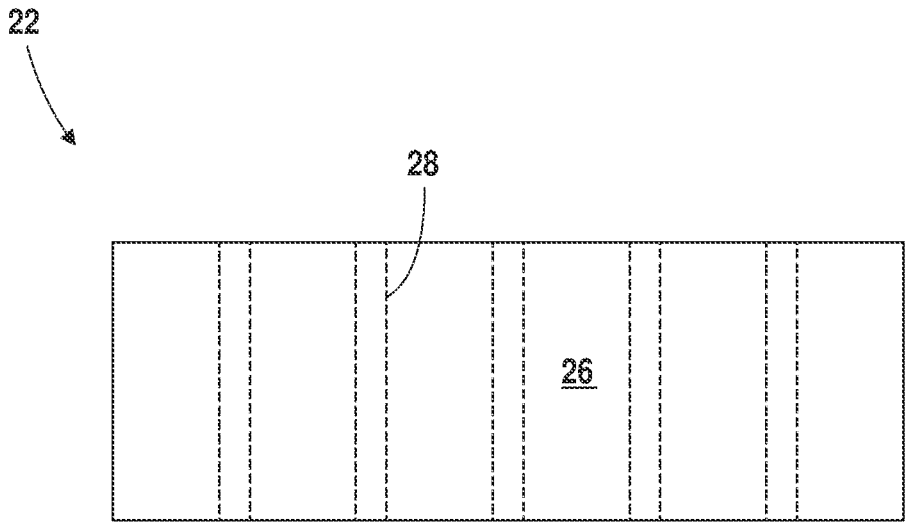
FIG. 4 is a front view of an embodiment of a ribbon.
Figure 5:
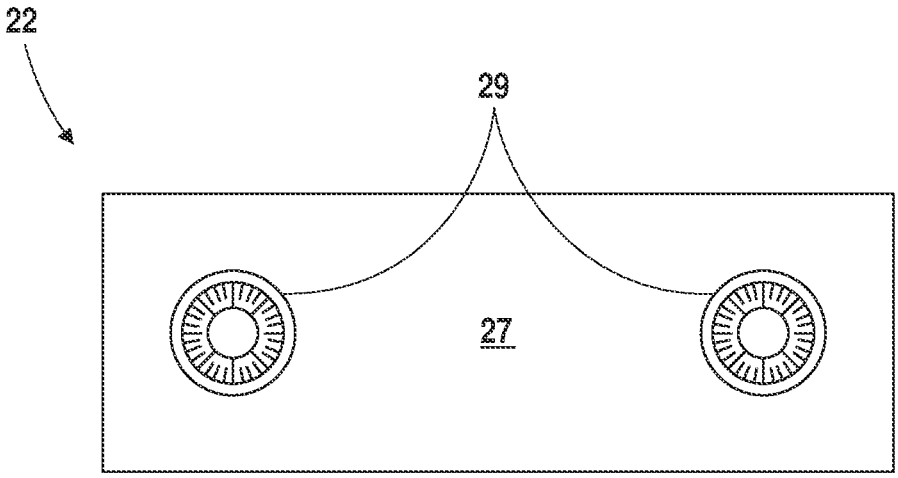
FIG. 5 is a back view of an embodiment of a ribbon.
Figure 7:
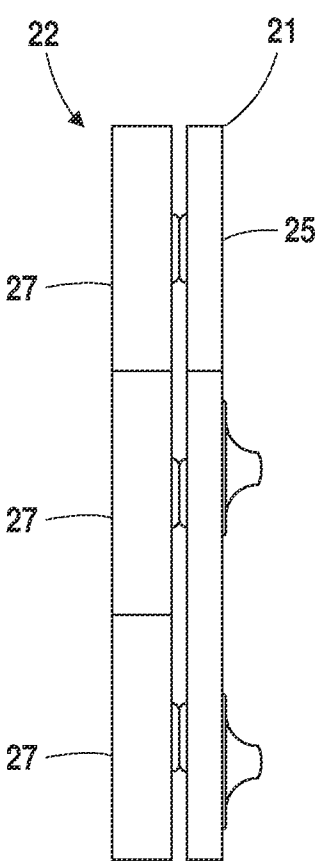
FIG. 7 is a right view of the first embodiment of the ribbon rack with the ribbons attached to the backing.
Figure 6:
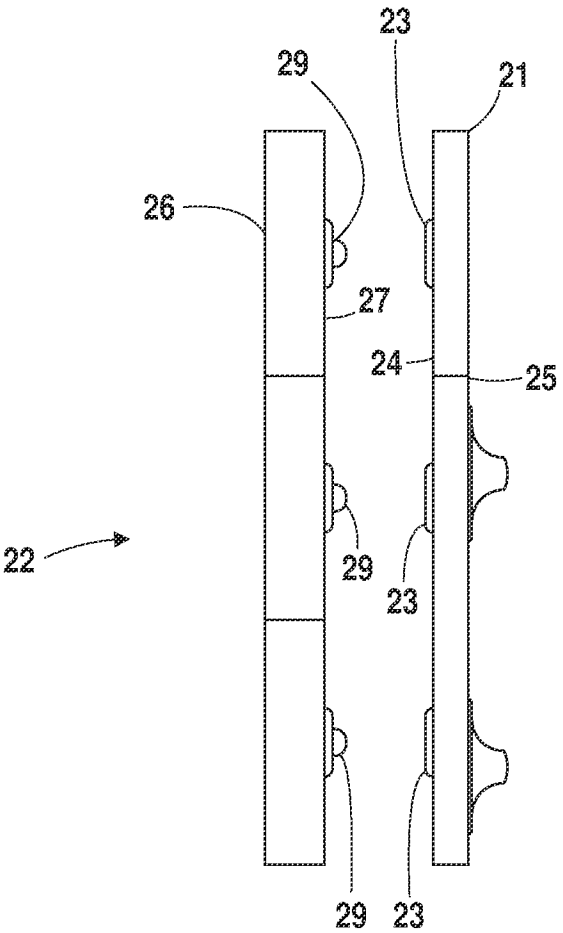
FIG. 6 is a right side view of the first embodiment of the ribbon rack with the ribbons detached from the backing.

Referring to FIGS. 4 and 5, each of the ribbons 31-35 of the first arrangement of a plurality of ribbons 22 comprise a display side 26 and an attachment side 27. The display side 26 consists of a ribbon design 28. A pair of male snap studs 29 are attached to the attachment side 27 of each of the ribbons 31-35. It is easily understood that the placement of the male snap stud pairs 23 and the female snap socket pairs 29 can be reversed where the male snap stud pairs 23 are positioned on the attachment side 27 of each of the ribbons 31-35 and the female snap socket pairs are positioned on the front side 24 of the first backing 21.

Each ribbon 31-35 of the first arrangement of a plurality of ribbons 22 can be removed from the ribbon rack 20, by disconnecting the snap fit between female snap socket pairs 29 of each ribbon 31-35 and the corresponding male snap stud pairs of the first backing 21.

In order to display a different number of ribbons or a different arrangement of ribbons, the user can remove each of the ribbons 31-35 from the first backing 21 and re-use the ribbons 31-35 with a different arrangement on the first backing 21 or as part of a second ribbon rack with a new backing and the possible addition of new ribbons.

Figure 8:
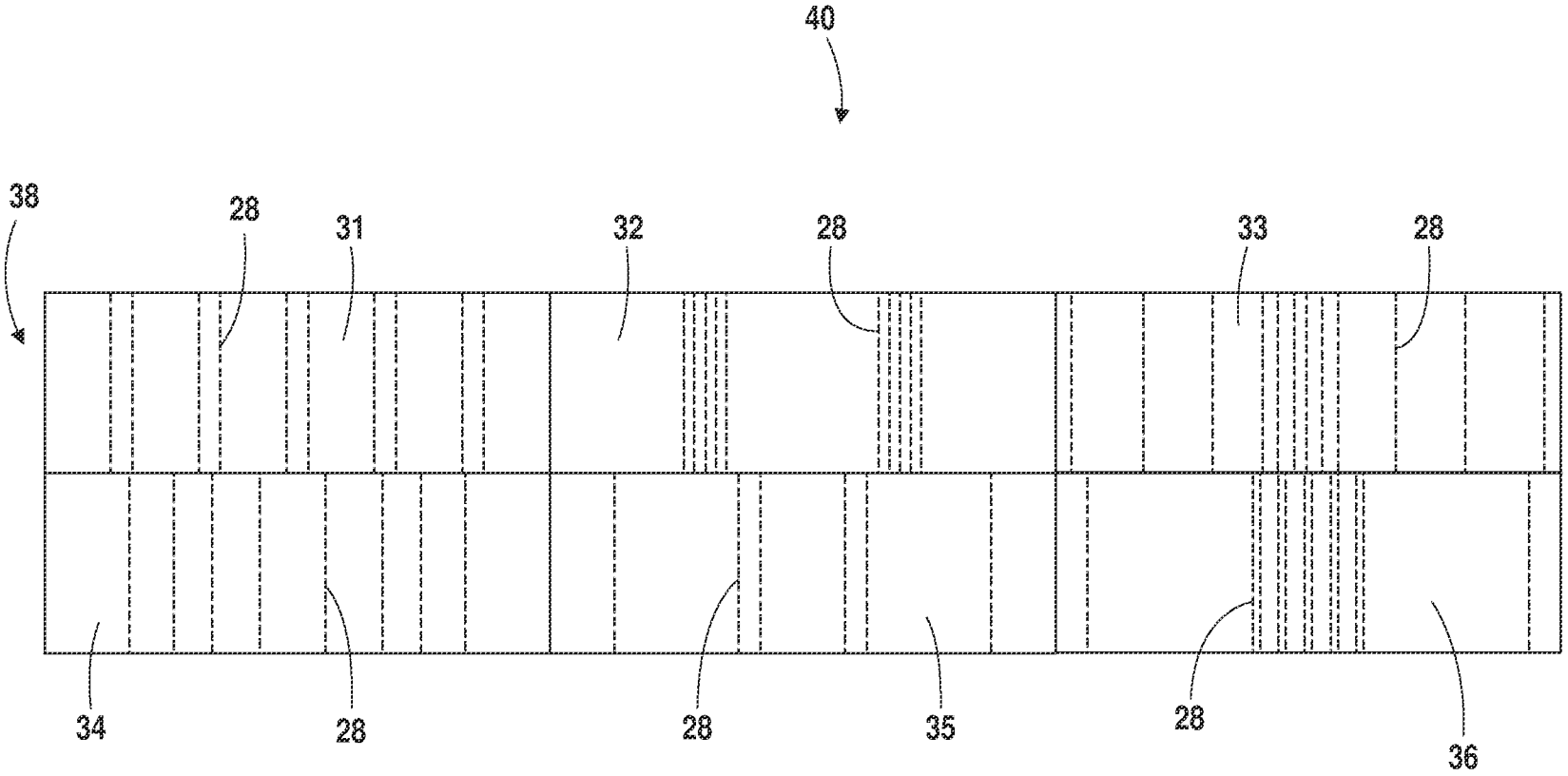
FIG. 8 is a front view of a second embodiment of a fully assembled ribbon rack.

FIG. 8 shows a second embodiment of a ribbon rack 40 displaying six ribbons including the five ribbons 31-35 displayed in the first embodiment of the ribbon rack 20 and a new sixth ribbon 36.

Figure 9:
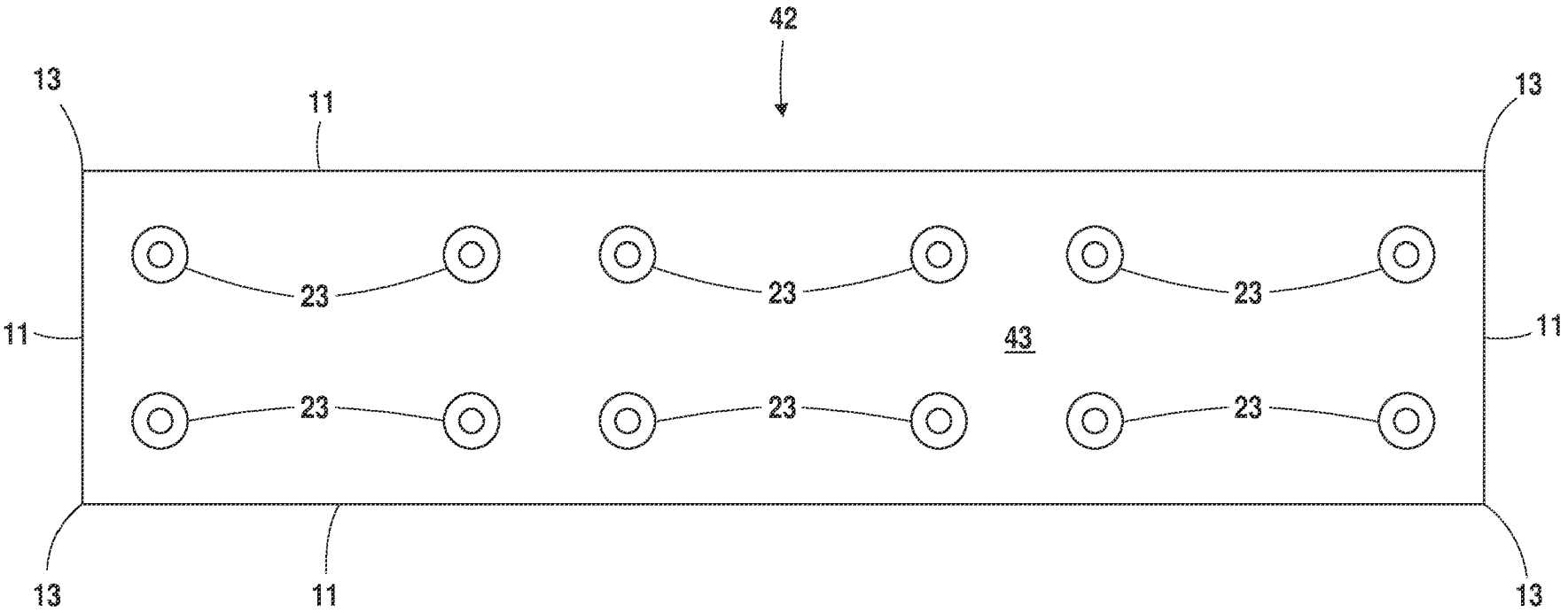
FIG. 9 is a front view of the backing of the second embodiment of the ribbon rack.

Referring to FIG. 9, the second embodiment of the ribbon rack 40 has a second backing 44 that is sized and shaped to correspond to the shape of second arrangement of a plurality of ribbons 42. With the exception of its size and shape, the second embodiment of the ribbon rack 40 has the same structure as the first embodiment of the ribbon rack 20 including: ribbons 31-36 with a display side 26 and an attachment side 27; a second backing 44 with a front side 43 and a back side (not shown); female snap socket pairs 29; and male snap stud pairs 23.

As is shown in FIGS. 8 and 9, the ribbons 31-35 can be used in a first embodiment 20 (see FIG. 1), removed and reused in a second embodiment 40. The snap fit connection between the backing and the ribbons in each embodiment allow the ribbons to be removed without damage to the ribbon and reused. The snap fit connection between the ribbons and the backing allows the user to re-use the same ribbons as many times as necessary without damaging the ribbons or the backing by tearing off ribbons that are attached to the backing via an adhesive. The snap-fit reduces the users' need to buy new versions of the same ribbon every time the user updates his or her ribbon rack.

Those skilled in the art understand that the ribbon rack, as described, can be modified to work with other snap type fasteners.

I claim:

1. A ribbon rack comprising:

at least one ribbon having an attachment side and a display side;

a backing having a back side and front side;

wherein said backing is sized and shaped to correspond to the size and shape of said at least one ribbon;

at least one pair of male snap studs attached to said front side of said backing;

at least one pair of female snap sockets attached to said attachment side of said at least one ribbon; and wherein said at least one pair of female snap sockets form a snap fit with said at least one pair of male snap studs forming an attachment between said backing and said at least one ribbon.

2. The ribbon rack of claim 1 wherein said at least one ribbon is detachable from said backing and reusable.

3. The ribbon rack of claim 2 wherein:

at least one ribbon is a first arrangement of a plurality of ribbons;

each ribbon of said first arrangement of a plurality of ribbons comprises of at least one pair of female snap sockets attached to said attachment side of each ribbon;

said backing is shaped and sized to correspond to the shape and size of said first arrangement of a plurality of ribbons; and said backing comprises a plurality of pairs of male snap studs attached to said front side of said backing and positioned to correspond to the position of the pairs of female snap sockets attached to each of said ribbons of said first arrangement of a plurality of ribbons.

4. The ribbon rack of claim 3 wherein:

each of said ribbons of said plurality of ribbons is rectangular in shape; and each of said ribbons of said plurality of ribbons are positioned adjacent to each other with a clearance fit.

5. The ribbon rack of claim 4 wherein said backing comprises a plurality of parallel and perpendicular edges.

6. The ribbon rack of claim 3 wherein each of said ribbons in said plurality of ribbons is detachable from said backing and reusable in a second arrangement of a plurality of ribbons.

7. A ribbon rack comprising:

at least one ribbon having an attachment side and a display side;

a backing having a back side and front side;

wherein said backing is sized and shaped to correspond to the size and shape of said at least one ribbon;

at least one pair of male snap studs attached to said attachment side of said at least one ribbon;

at least one pair of female snap sockets attached to said front side of said backing; and wherein said at least one pair of female snap sockets form a snap fit with said at least one pair of male snap studs forming an attachment between said backing and said at least one ribbon.

8. The ribbon rack of claim 7 wherein said at least one ribbon is detachable from said backing and reusable.

9. The ribbon rack of claim 7 wherein:

at least one ribbon is a first arrangement of a plurality of ribbons; and said backing is shaped and sized to correspond to the shape and size of said arrangement of plurality of ribbons, each ribbon of said first arrangement of a plurality of ribbons comprises at least one pair of male snap studs attached to said attachment side of each ribbon; and said backing comprises a plurality of pairs of female snap sockets attached to said front side of said backing and positioned to correspond to the position of the pair of male snap studs attached to each of said ribbons of said first arrangement of a plurality of ribbons.

10. The ribbon rack of claim 9:

wherein each of said ribbons of said plurality of ribbons is rectangular in shape; and wherein each of said ribbons of said first arrangement of a plurality of ribbons are positioned adjacent to each other with a clearance fit.

11. The ribbon rack of claim 10 wherein said backing comprises a plurality of parallel and perpendicular edges.

12. The ribbon rack of claim 9 wherein each of said ribbons in said first arrangement of a plurality of ribbons is detachable from said backing and reusable in a second arrangement of a plurality of ribbons.

13. A method of assembling a ribbon rack comprising the steps of:

selecting at least one ribbon from a selection of available ribbons;

wherein said at least one ribbon comprises at least one pair of female snap sockets attached to a side of at least one ribbon;

selecting a first backing;

wherein said first backing is sized and shaped to correspond to the shape of said at least one ribbon;

wherein said first backing comprises at least one pair of male snap studs attached to a side of first said backing; and attaching said at least one ribbon to said first backing with a snap fit connection between said at least one pair of female snap sockets and at least one pair of said male snap studs.

14. The method of assembling a ribbon rack of claim 13 further comprising the steps of:

detaching said at least one ribbon from said first backing;

selecting a second backing;

wherein said second backing comprises at least one pair of male snap studs attached to a side of said second backing;

wherein said second backing is sized and shaped to correspond to the size and shape of at least one ribbon; and attaching said at least one ribbon to said second backing with a snap fit connection between said at least on pair of female snap sockets and at least one pair of male snap studs.

15. The method of assembling a ribbon rack of claim 13 wherein:

said at least one ribbon is a first arrangement of a plurality of ribbons;

each ribbon of said first arrangement of a plurality of ribbons comprises at least one pair of female snap sockets attached to a side of each ribbons; and said first backing is sized and shaped to correspond to the shape of the first arrangement of said plurality of ribbons.

16. The method of assembling a ribbon rack of claim 15 further comprising the steps of:

detaching said first arrangement of a plurality of ribbons from said first backing;

selecting a second backing;

wherein said second backing comprises a plurality of pairs of male snap studs attached to a side of said second backing;

wherein said second backing is sized and shaped to correspond to the size and shape of said first arrangement of a plurality of ribbons; and attaching said first arrangement of a plurality of ribbons to said second backing with snap fit connections between said at least one of pair of female snap sockets on each ribbon and said plurality of pairs of male snap studs.

17. A method of assembling a ribbon rack comprising the steps of:

selecting at least one ribbon from a selection of available ribbons;

wherein said at least one ribbon comprises at least one pair of male snap studs attached to a side of at least one ribbon;

selecting a first backing;

wherein said first backing is sized and shaped to correspond to the shape of said at least one ribbon;

wherein said first backing comprises at least one pair of female snap sockets attached to a side of said backing;

attaching said at least one ribbon to said first backing with a snap fit connection between said at least one pair of female snap sockets and at least one pair of said male snap studs.

18. The method of assembling a ribbon rack of claim 17 further comprising the steps of:

detaching said at least one ribbon from said first backing;

selecting a second backing;

wherein said second backing comprises at least one pair of female snap sockets attached to a side of said second backing;

wherein said second backing is sized and shaped to correspond to the size and shape of at least one ribbon; and attaching said at least one ribbon to said second backing with a snap fit connection between said at least on pair of female snap sockets and at least one pair of male snap studs.

19. The method of assembling a ribbon rack of claim 17 wherein:

said at least one ribbon is a first arrangement of a plurality of ribbons;

each ribbon of said first arrangement of a plurality of ribbons comprises at least one pair of male snap studs attached to a side of each ribbon; and said backing is sized and shaped to correspond to the shape of the first arrangement of said plurality of ribbons.

20. The method of assembling a ribbon rack of claim 19 further comprising the steps of:

detaching said first arrangement of a plurality of ribbons from said first backing;

selecting a second backing;

wherein said second backing comprises a plurality of pairs of female snap sockets attached to a side of said second backing;

wherein said second backing is sized and shaped to correspond to the size and shape of said first arrangement of a plurality of ribbons; and attaching said first arrangement of a plurality of ribbons to said second backing with a snap fit connection between said plurality of pairs of female snap sockets and at least one pair of male snap studs on each ribbon.

* * * * *